US010308401B2

(12) United States Patent
Ng

(10) Patent No.: US 10,308,401 B2
(45) **Date of Patent: *Jun. 4, 2019**

(54) FOOD STORAGE UNIT

(71) Applicant: Kok Leong Ng, Brooklyn, NY (US)

(72) Inventor: Kok Leong Ng, Brooklyn, NY (US)

( * ) Notice: Subject to any disclaimer, the term of this patent is extended or adjusted under 35 U.S.C. 154(b) by 12 days.

This patent is subject to a terminal disclaimer.

(21) Appl. No.: 15/859,900

(22) Filed: Jan. 2, 2018

(65) Prior Publication Data

US 2018/0118419 A1 May 3, 2018

Related U.S. Application Data

(63) Continuation-in-part of application No. 15/288,946, filed on Oct. 7, 2016.

(60) Provisional application No. 62/239,074, filed on Oct. 8, 2015.

(51) Int. Cl.
*B65D 43/02* (2006.01)
*B65D 21/02* (2006.01)

(52) U.S. Cl.
CPC ..... *B65D 43/0212* (2013.01); *B65D 21/0217* (2013.01); *B65D 21/0219* (2013.01); *B65D 43/0206* (2013.01); *B65D 2543/0074* (2013.01); *B65D 2543/00092* (2013.01); *B65D 2543/00296* (2013.01); *B65D 2543/00351* (2013.01); *B65D 2543/00462* (2013.01); *B65D 2543/00509* (2013.01); *B65D 2543/00527* (2013.01); *B65D 2543/00537* (2013.01); *B65D 2543/00555* (2013.01); *B65D 2543/00657* (2013.01); *B65D 2543/00685* (2013.01); *B65D 2543/00768* (2013.01); *B65D 2543/00796* (2013.01)

(58) Field of Classification Search
CPC ..... B65D 43/0206; B65D 21/029; B65D 2543/00462
See application file for complete search history.

(56) References Cited

U.S. PATENT DOCUMENTS

2010/0155289 A1* 6/2010 Nazareth ..... B65D 43/0241 206/557
2012/0168338 A1* 7/2012 Wu ..... B65D 21/0222 206/505

* cited by examiner

*Primary Examiner* — Andrew T Kirsch
*Assistant Examiner* — Don M Anderson

(57) ABSTRACT

A food storage unit provides a container and a cover which use an interference fit to snap the cover onto the container. The two engage with each other by a first lip (of the container) and a second lip (of the cover). The lips are configured to have an obtuse angle of 95 degrees, helping to create a better fit between the two. The second lip deforms when placed over the first lip; the resulting pressure and friction helps to seal the cover to the container. To help create a more secure attachment, a latching member is connected to the second lip. The latching member is positioned just below the first lip, such that the cover cannot be lifted straight up until a person manually moves the latching member away from the first lip. This helps prevent the cover from accidentally coming loose from the container.

20 Claims, 7 Drawing Sheets

FOOD STORAGE UNIT

The current application claims a priority to the U.S. Provisional Patent application Ser. No. 62/239,074 filed on Oct. 8, 2015 and U.S. Non-Provisional patent application Ser. No. 15/288,946 filed on Oct. 7, 2016.

FIELD OF THE INVENTION

The present invention relates to storage containers. In particular, the present invention relates to a food container and cover with specifically angled lip components which prevent the cover from coming loose and detaching in unwanted circumstances.

BACKGROUND OF THE INVENTION

Food containers are devices used for the storage and transportation of food. These objects often incorporate the use of lids which attach over the top of the container in order to cover and preserve contents of the container for longer periods of time. The lid also serves to inhibit the buildup of harmful bacteria and prevent unwanted leakage. Tupperware (a colloquial name for food storage containers) and devices alike are often made of microwaveable plastic and commonly use various lip designs which allow lids to snap onto corresponding containers. Problems exist, however, as the lids often come loose and detach during unwanted circumstances. Most noticeably, this occurs during transportation, when containers are knocked around or when being heated up in microwaves, as the increase in temperature leads to material expansion and deformation.

It is therefore an objective of the present invention to introduce a new food container and lid device. The present invention includes uniquely shaped container and cover lips which snap together, but will not come loose due to various outwards sloping angles. The present invention is stackable, allowing multiple containers to be seated on top of each other, with tight snap-on covers (lids). The cover and container lips utilize stronger and thicker edges compared to other inventions, especially at the bottom where the cover locks in. Unlike other devices, the cover will not snap off when the container is heated up. Overall, the present invention is sturdy, safe, reliable, practical, and suited for mass production.

DETAIL DESCRIPTIONS OF THE INVENTION

All illustrations of the drawings are for the purpose of describing selected versions of the present invention and are not intended to limit the scope of the present invention.

Figure 1:
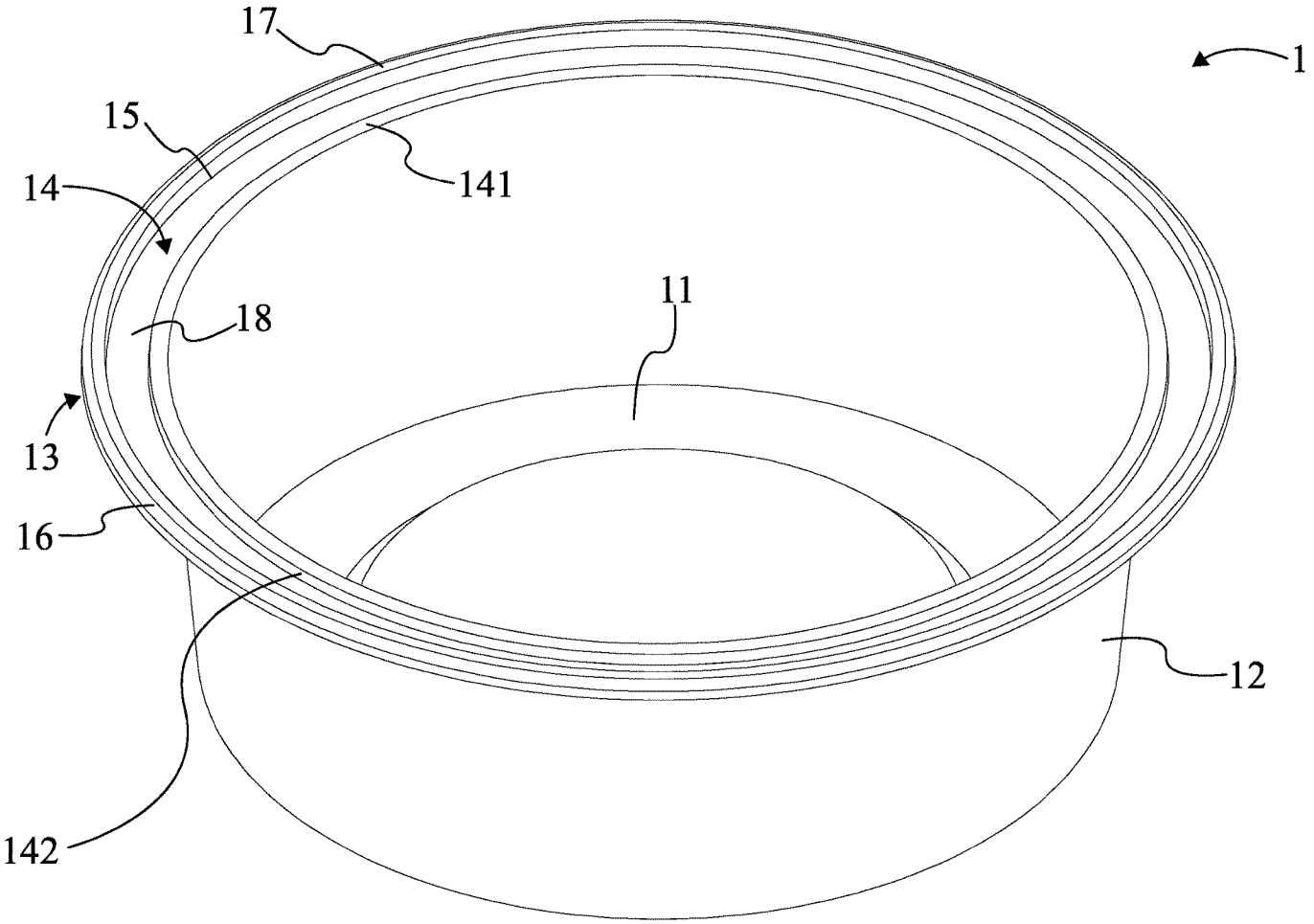
FIG. 1 is a top perspective view showing a container of the present invention.
Figure 2:
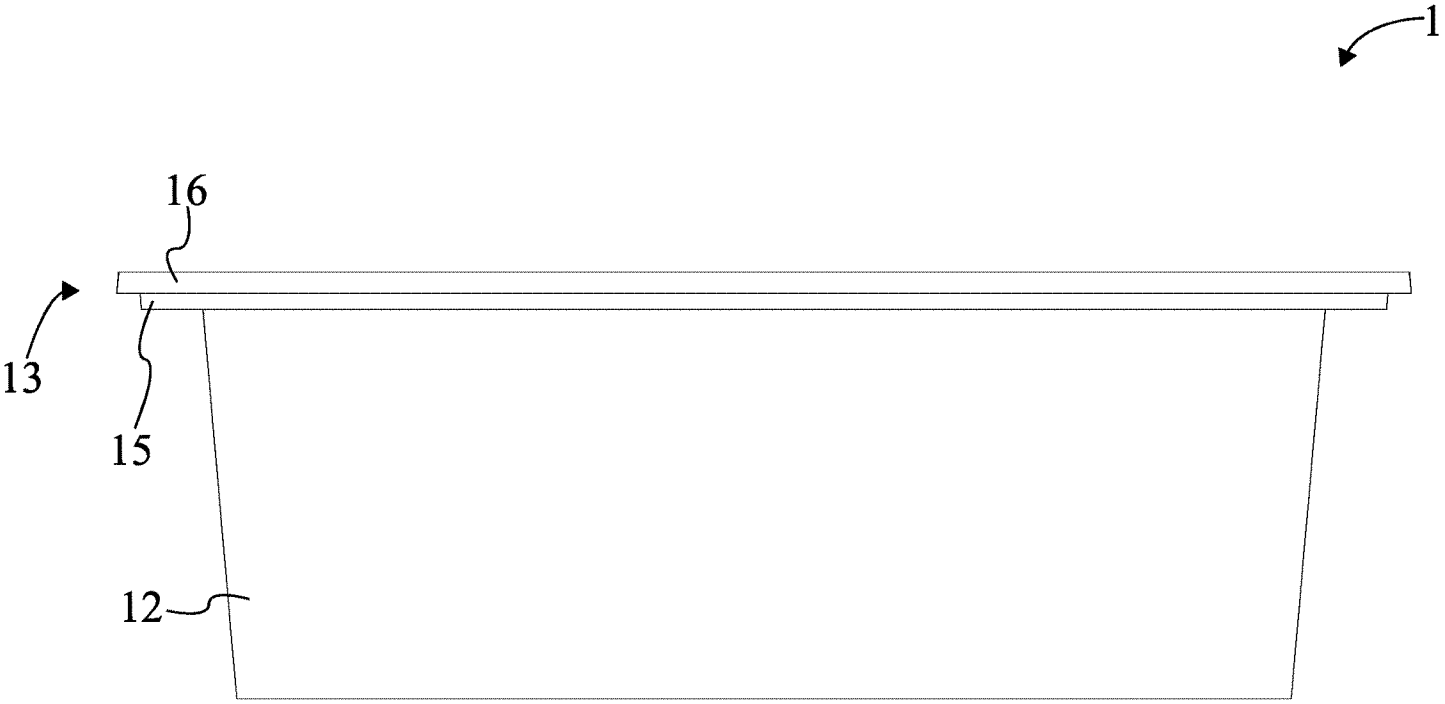
FIG. 2 is a front elevational view showing the container of the present invention.
Figure 3:
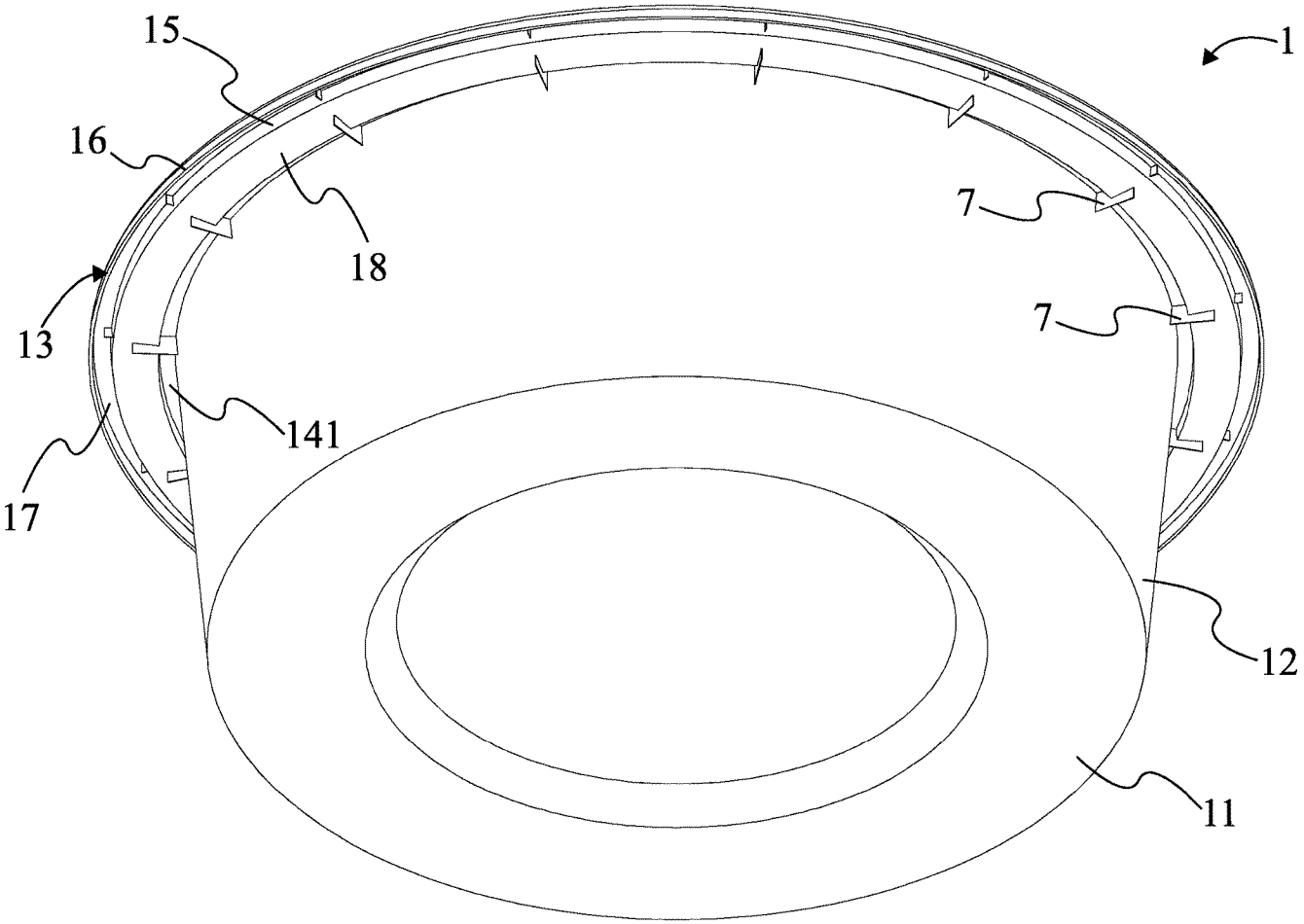
FIG. 3 is a bottom perspective view showing the container of the present invention.
Figure 4:
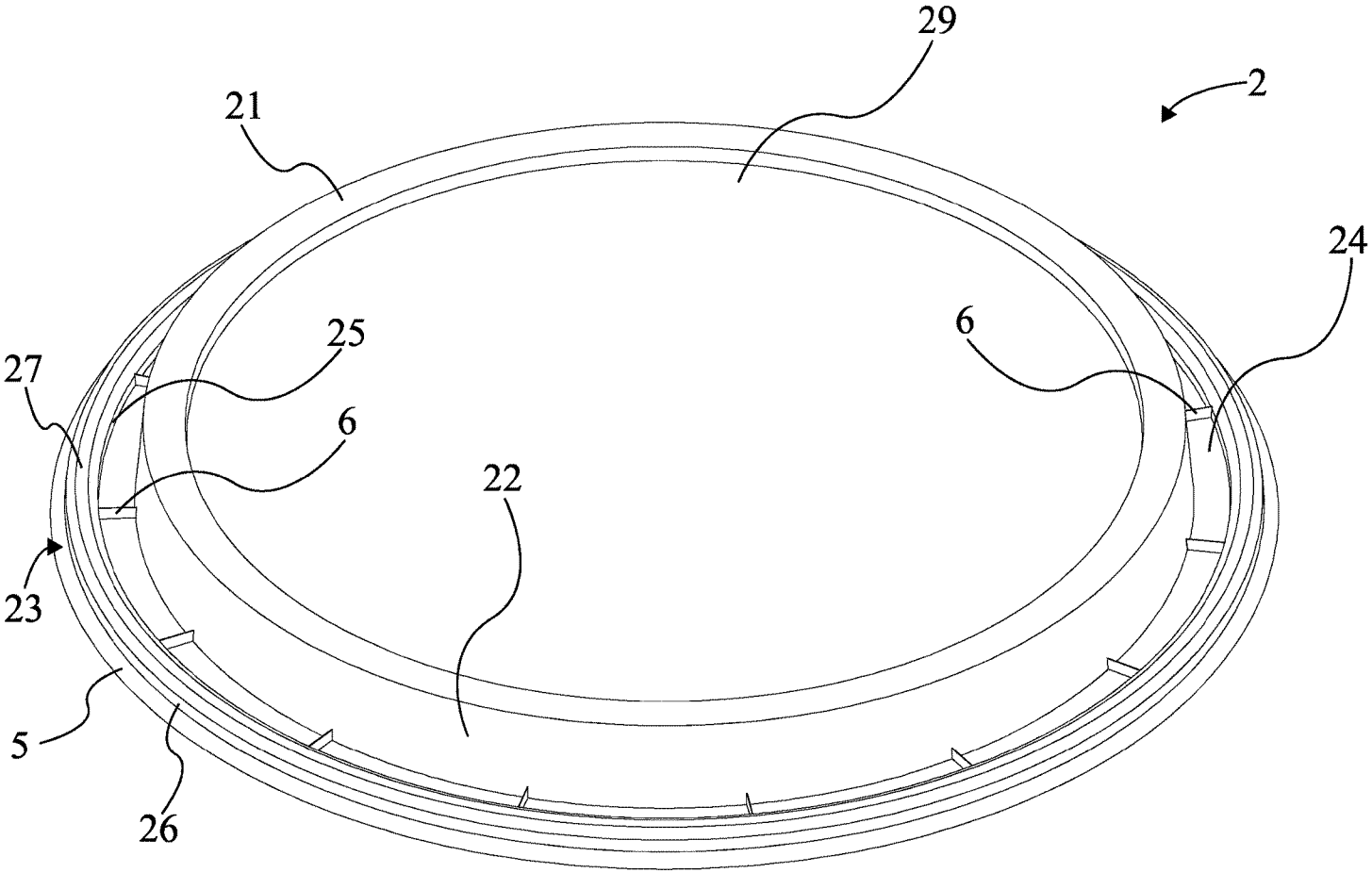
FIG. 4 is a top perspective view showing a cover of the present invention.
Figure 5:
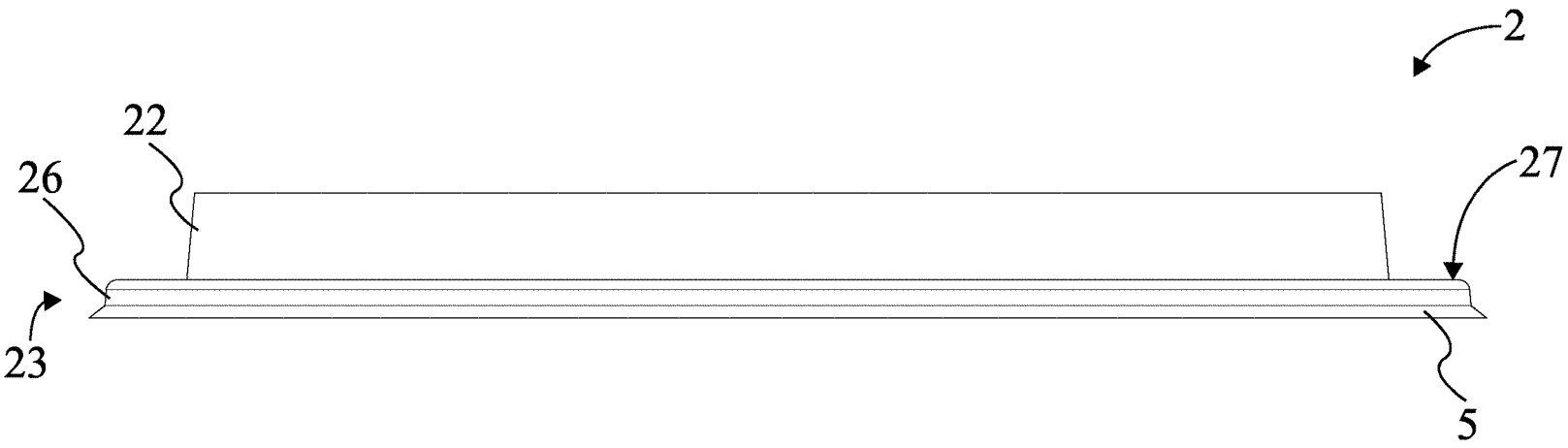
FIG. 5 is a front elevational view showing the cover of the present invention.
Figure 6:
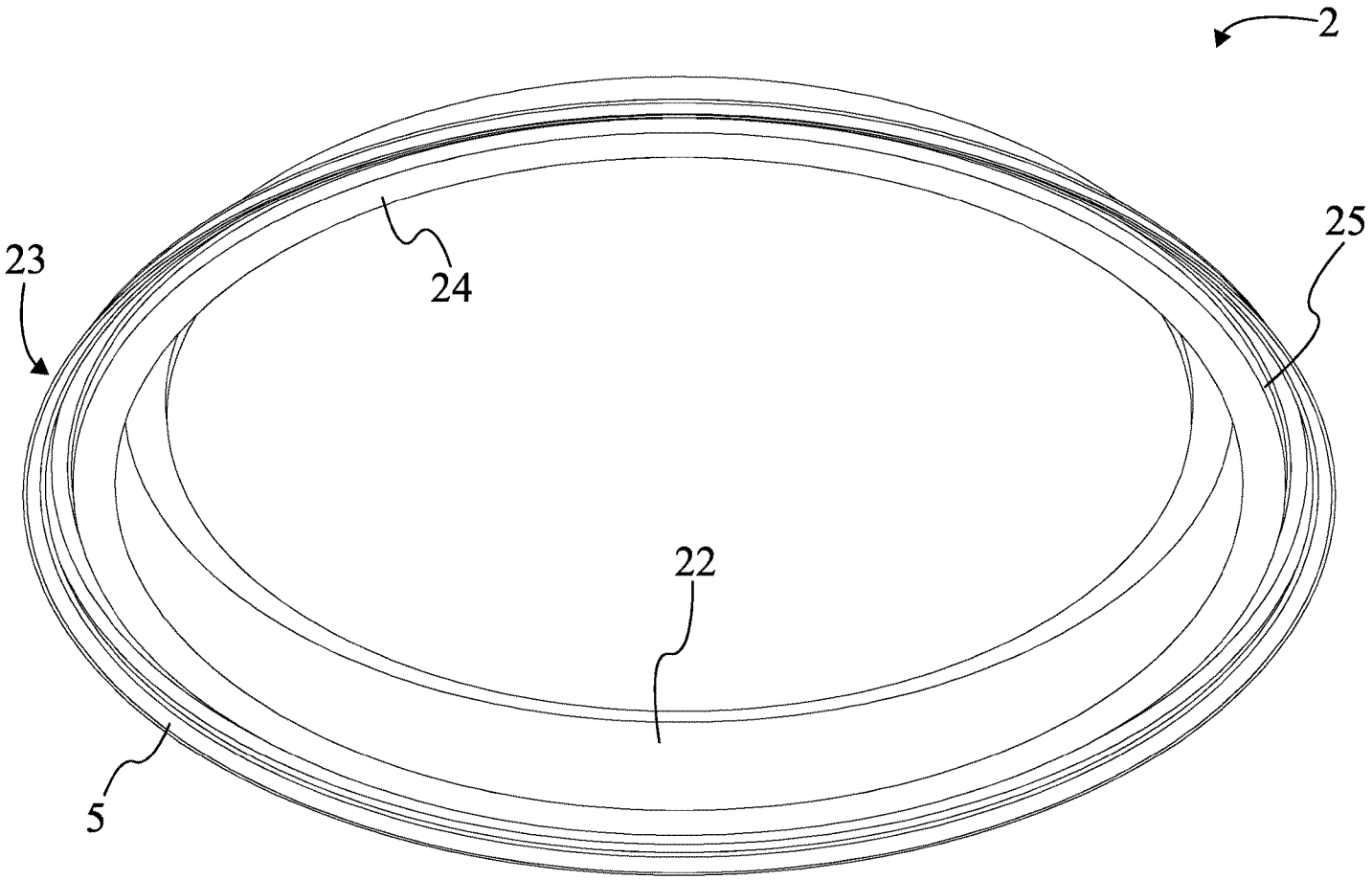
FIG. 6 is a bottom perspective view showing the cover of the present invention.
Figure 7:
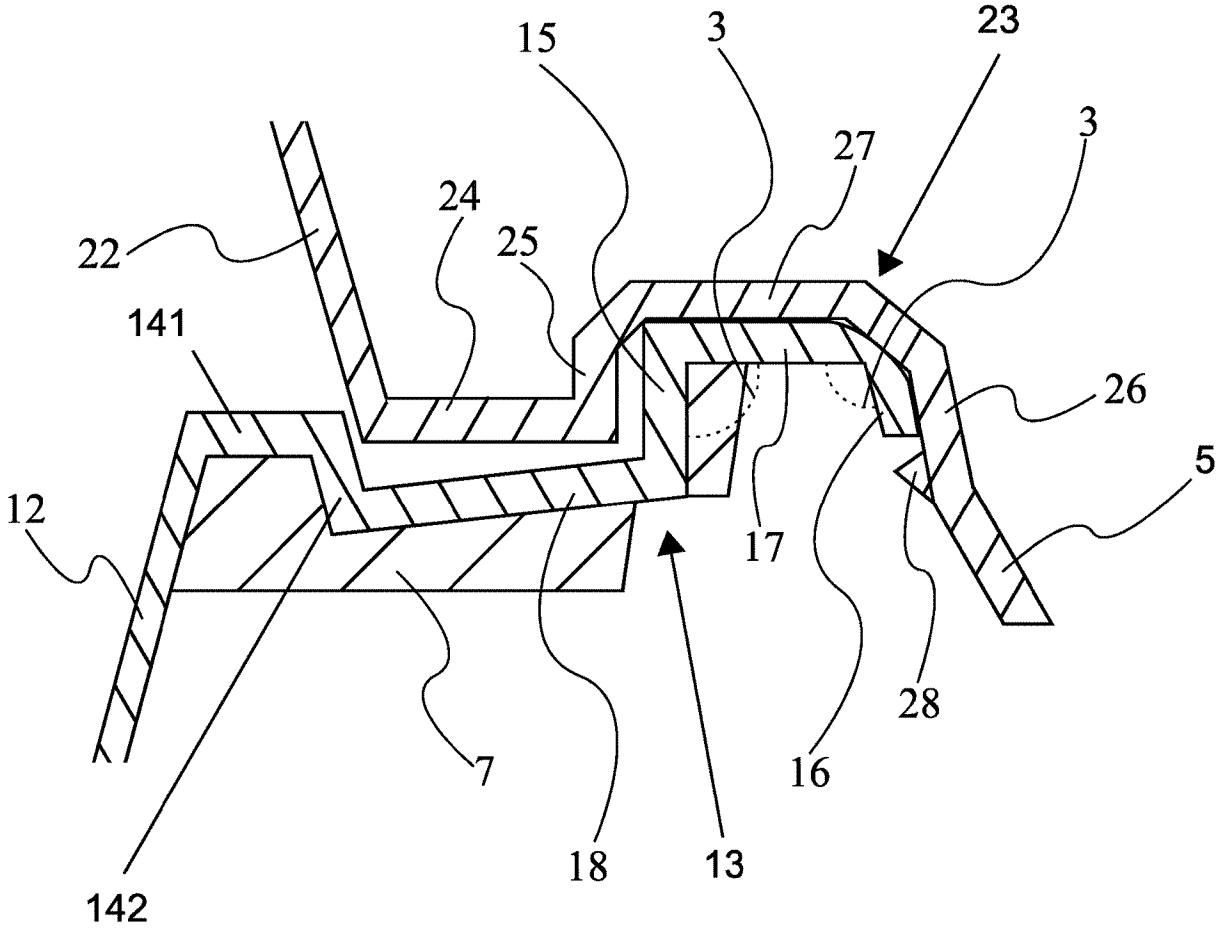
FIG. 7 is a magnified cross section view showing how the cover attaches to the container.

The present invention is a food storage unit that includes a food container 1 and cover 2. The present invention is uniquely shaped, such that the container 1 and cover 2 easily snap together in a secure fashion. Thanks to the angles and slopes of several components, the container 1 and cover 2 remain secured to each other, once attached. They do not accidentally loosen from each other during normal use. Of course, a user can still easily separate the container 1 and cover 2 when desired by disengaging certain components of the container 1 and the cover 2. Further, the present invention is constructed to be stackable, allowing multiple containers (with attached covers 2) to be positioned atop each other into a vertical stack. It is noted that while the present invention is primarily intended to be used for the purpose of storing and transporting food or similar contents, the present invention may be utilized in other settings, situations, and scenarios. The container 1 is illustrated in FIG. 1-FIG. 3, the cover 2 in FIG. 4-FIG. 6, and their attachment via FIG. 7.

The present invention is a food receptacle with lid. The present invention comprises a container 1 and a cover 2. The cover 2 can be attached to the container 1 to create an enclosed region with the container 1. The container 1 comprises a base 11, a first lateral body 12, a channel 14, and a first lip 13. The cover 2 comprises a top surface 21, a second lateral body 22, a sealing insert 24, and a second lip 23. The second lip 23 interfaces with the first lip 13 in a manner that supports attachment of the cover 2 to the container 1. Effectively, a snap connection allows the first lip 13 to interface with the second lip 23, resulting in attachment of the cover 2 to the container 1.

The basic operating principle of the present invention is the flexing of the cover 2 (more specifically the second lip 23 and the sealing insert 24) to fit to the container 1 (more specifically the first lip 13 and the channel 14). When the cover 2 is attached atop the container 1, the sides of the cover 2 flex to match the contour of the container 1. This results in an interference fit (i.e. the snap connection earlier reference) between the cover 2 and container 1, which securely engages the cover 2 to the container 1 during storage and transport.

Further defining the container 1, the channel 14 is perimetrically connected to the first lateral body 12. Additionally, the first lip 13 is perimetrically connected to the channel 14. The first lateral body 12 itself is perimetrically connected to the base 11; this creates the basic structure of the container 1, allowing for items to be placed atop the base 11 within the first lateral body 12. The region bounded by the first lateral body 12 and the base 11 is a receptacle for contents, for example food or other items.

The first lip 13 and the channel 14 allow the container 1 to receive a matching part from the cover 2 (i.e. the second lip 23 and the sealing insert 24) in order to secure the cover 2 to the container 1. Thus, the channel 14 is preferably positioned at an upper end of the first lateral body 12. The base 11, conversely, is positioned at a lower end of the first lateral body 12. In short, the base 11 and the channel 14 are positioned opposite each other across the first lateral body 12.

The first lip 13 itself comprises, a first inner wall 15, a first outer wall 16, and a first ridge 17. The channel 14 is positioned adjacent to the first lateral body 12. Accordingly, the channel 14 is delineated by the first lateral body 12, and the first inner wall 15. The channel 14 serves as a receptacle for the sealing insert 24 of the second lip 23, as later described. Additionally, the channel 14 comprises a floor 18, a channel ridge 141, and a third lateral body 142. The channel ridge 141 is perimetrically connected to the first lateral body so that the channel ridge 141 retains the channel in a position advantageous for receiving the sealing insert 24. The third lateral body 142 is perimetrically connected to the channel ridge 141. Further, the channel ridge 141 is positioned in between the third lateral body 142 and the first lateral body 12. As a result, the channel ridge 141 and the third lateral body 142 maintain the floor 18 in a position that facilitates engaging the sealing insert 24. Specifically, the floor 18 is perimetrically connected to the third lateral body 142. Moreover, the first inner wall 16 is perimetrically connected to the floor 18. Accordingly, the floor 18 forms the bottom of a circular groove that is delineated by the third lateral body 142 and the first inner wall 16. This circular groove functions as a receptacle that the sealing insert 24 engages into when the cover 2 is attached to the container 1. Additionally, the floor 18 is positioned offset from the channel ridge 141 and the first ridge 17. As a result, the floor 18 is maintained in a position that facilitates establishing a detachable connection between the container 1 and the cover 2.

The channel 14 is shaped to facilitate establishing a robust-yet-detachable connection between the container 1 and the cover 2. Specifically, the channel ridge 141 is positioned parallel to the base 11. Additionally, the third lateral body 142 is angularly offset from the channel ridge 141 by an obtuse angle. Furthermore, the floor 18 is angularly offset from third lateral body 142 by an obtuse angle. As a result, the floor 18, is angled to maintain the first lip 13 in a position that facilitates engaging the second lip 23. In addition to facilitating the formation of a connection between the container 1 and the cover 2, the channel 14 is designed to support the weight of the cover 2 and any storage containers stacked thereon. To facilitate this, the present invention comprises a plurality of container-support tabs 7. Each of the plurality of container-support tabs 7 is a rigid member that is integrated into the container 1. Specifically, the plurality of container-support tabs 7 is connected across the channel 14 and adjacent to the first lateral body 12. Additionally, the plurality of container-support tabs 7 is radially distributed around the first lateral body 12. Consequently, the plurality of container-support tabs 7 are able to support the underside of the channel 14. Thus, preventing the channel 14 and the first lip 13 from becoming irreparably deformed when the cover 2 is attached to the container 1 or when storage containers are stacked upon the cover 2.

Connected adjacent to the first inner wall 15, at a top edge, is the first ridge 17. The first ridge 17 is thus positioned opposite the floor 18 along the first inner wall 15. Further, the first ridge 17 is orientated away from the first inner wall 15, such that it protrudes away from the first inner wall 16 and first lateral body 12. Restated, the first ridge 17 is positioned adjacent to the first inner wall 15, opposite the floor 18. The first outer wall 16 is adjacently connected to the first ridge 17. The first outer wall 16 is positioned at the outermost area of the container 1; effectively, the first ridge 17 is connected between the first inner wall 15 and the first outer wall 16.

The above describes a basic configuration of components for the container 1 of the present invention. Different embodiments may be derived from this core setup, as later described. Addressing the cover 2, the second lip 23 is adjacently and perimetrically connected around the second lateral body 22. The second lateral body 22 is likewise adjacently and perimetrically connected around the top surface 21. This results in the basic configuration for the cover 2. The top surface 21 serves to completely enclose an interior volume of a container 1 (when the cover 2 and the container 1 are in an attached configuration) while the second lip 23 enables attachment of the cover 2 to the container 1.

The second lip 23 is very similar to the first lip 13, in that the second lip 23 comprises a second inner wall 25, a second ridge 27, and a second outer wall 26. The second lip 23 also comprises a sealing insert 24, which interfaces with the channel 14 of the first lip 13. The sealing insert 24 is adjacently connected to the second lateral body 22. The sealing insert 24 is positioned exterior to the second lateral body 22, and just below a bottom edge of the second lateral body 22. In short, the sealing insert 24 is contoured to fit into the channel 14 of the first lip 13, allowing for the cover 2 to attach to the container 1.

The second inner wall 25 is adjacently connected to the sealing insert 24, opposite the second lateral body 22. Resultantly, the sealing insert 24 is positioned between the second lateral body 22 and the second inner wall 25. Paralleling the first lip 13, the second ridge 27 serves as a rim that connects the second outer wall 26 to the second inner wall 25. The second ridge 27 is adjacently connected to an upper edge of the second inner wall 25, opposite the sealing insert 24. The second outer wall 26 is offset from the second inner wall 25, the latter separated from the former by the second ridge 27. Thus, the second outer wall 26 is adjacently connected to the second ridge 27, at an end opposite the second inner wall 25.

In addition to the above components, the second lip 23 further comprises a latching member 28 and a lateral-release ridge 5. The latching member 28 is adjacently connected to a bottom edge of the second outer wall 26. The latching member 28 presses against the first outer wall 15 of the container 1 to lock the cover 2 to the container 1, as later described. Further, the lateral-release ridge 5 is adjacently connected to the latching member 28. Additionally, the latching member 28 is positioned in between the lateral-release ridge and the second outer wall 26. Thus positioned, the lateral-release ridge 5 facilitates connecting and disconnecting the cover 2 and container 1. The present invention further comprises a plurality of cover-support tabs 6 that bolster the structural integrity of the connection formed between the second lateral body 22 and the second lip 23. Specifically, the plurality of cover-support tabs 6 is connected in between the second lateral body 22 and the second inner wall 25. Additionally, the plurality of cover-support tabs 6 is connected adjacent to the sealing insert 24. Furthermore, the plurality of cover-support tabs 6 is radially distributed around the second lateral body 22. As a result, the plurality of cover-support tabs 6 prevents the sealing insert 24 and the second lip 23 from becoming irreparably deformed when the cover 2 is attached to the container 1.

The above describes a basic configuration of components for the cover 2 of the present invention. In combination with the basic configuration for the container 1, a user is able to attach and detach the cover 2 from the container 1. This supports storage and retrieval of foodstuffs, as well as other items that a person might wish to place within the container 1 of the present invention.

In the preferred embodiment, the various walls are offset at specific angles. More specifically, the first inner wall 15 is offset from the first ridge 17 by an obtuse angle 3 of 95 degrees. Correspondingly, the second inner wall 25 is angularly offset from the second ridge 27 by an obtuse angle 3 of 95 degrees.

Mirroring this, the first outer wall 16 is angularly offset from the first ridge 17 by an obtuse angle 3 of 95 degrees.

The second outer wall 26, is also offset from the second ridge 27; however, this offset is at a right angle 4 (90 degrees) rather than an obtuse angle 3.

The preferred 95 and 90 degree offsets result in the inner walls and outer walls being orientated at a slight slant, relative to a supporting surface (e.g. a table), rather than perfectly perpendicular. Thus, the second lip 23 squeezes the first lip 13. This helps to securely attach the cover 2 to the container 1, creating an enclosed storage region interior to said container 1 and cover 2.

Another property of the present invention, when the cover 2 is attached to the container 1, is the second outer wall 26 being offset from the first outer wall 16. Put more simply, there is a small gap between the outside edge of the first lip 13 and the inside edge of the second lip 23.

In one possible embodiment, a base-receiving indent 29 is positioned into the top surface 21. This indent 29 is a depression that is sized to receive the base 11 of a similarly sized container 1. This feature enables "stacking" of the present invention, in which the base 11 of one container 1 is placed into the indent 29 of an adjacent cover 2.

While the illustrated embodiment shows the container 1 as having a circular shape, in other embodiments different shapes may be used. Regarding food storage, one of the most common alternatives are rectangularly shaped containers 1, but ultimately any shape may be used within the scope of the present invention.

Further, in alternative embodiments of the present invention, different values may be provided for the obtuse angles 3 previously referenced. For example, the first inner wall 15 may be angularly offset from the first ridge 17 by an obtuse angle 3 of 110 degrees, rather than 95 degrees. Other values for the obtuse angle 3 remain possible, as long as they are greater than 90 degrees and less than 180 degrees.

Addressing material construction for the present invention, a number of materials are suitable as long as they meet a few requirements. One requirement is a pliable construction for the cover 2, as it is necessary for the cover 2 to flex in order to fit onto the container 1. Also, as the present invention is primarily intended for food storage, the material used for the container 1 and the cover 2 is preferably food safe. As people often like to reheat stored food prior to consumption, in some embodiments it may be desirable to use a microwave-safe material for the container 1, the cover 2, or both.

Although the invention has been explained in relation to its preferred embodiment, it is to be understood that many other possible modifications and variations can be made without departing from the spirit and scope of the invention as hereinafter claimed.

What is claimed is:

1. A food storage unit comprising:

a container;

a cover;

the container comprising a base, a first lateral body, a channel ridge, a third lateral body and a first lip;

the cover comprising a top surface, a second lateral body and a second lip;

the first lip comprising a channel, a first inner wall, a first outer wall, a first ridge and a floor;

the second lip comprising a sealing insert, a second inner wall, a second outer wall, a second ridge and a latching member;

the first lateral body being perimetrically connected to the base;

the channel ridge being perimetrically connected to the first lateral body;

the third lateral body being perimetrically connected to the channel ridge;

the first lip being perimetrically connected to the third lateral body;

the first lateral body being positioned in between the channel ridge and the first base;

the channel ridge being positioned in between the first lateral body and the third lateral body;

the third lateral body being positioned in between the channel ridge and the first lip;

the second lateral body being perimetrically connected to the top surface;

the second lip being perimetrically connected to the second lateral body;

the second lateral body being positioned in between the second lip and the top surface;

the cover being configured to be attached atop the container;

the floor being perimetrically connected to the third lateral body;

the first inner wall being perimetrically connected to the floor;

the first ridge being perimetrically connected to the first inner wall;

the first outer wall being perimetrically connected to the first ridge;

the floor being positioned in between the third lateral body and the first inner wall;

the first inner wall being positioned in between the floor and the first ridge;

the first ridge being positioned in between the first inner wall and the first outer wall;

the floor being positioned offset from the channel ridge and the first ridge;

the channel being delineated by the first inner wall, the floor and the third lateral body;

the floor being angularly offset from the third lateral body by an inside obtuse angle;

the inside obtuse angle being formed within the channel;

the sealing insert being perimetrically connected to the second lateral body;

the second inner wall being perimetrically connected to the sealing insert;

the second ridge being perimetrically connected to the second inner wall;

the second outer wall being perimetrically connected to the second ridge;

the latching member being perimetrically connected to the second outer wall;

the sealing insert being positioned in between the second lateral body and the second inner wall;

the second inner wall being positioned in between the sealing insert and the second ridge;

the second ridge being positioned in between the second inner wall and the second outer wall;

the second outer wall being positioned in between the second ridge and the latching member;

the latching member being positioned in between the second inner wall and the second outer wall; and the sealing insert being positioned into the channel and the latching member being positioned below and pressed against the first outer wall in response to the cover being attached atop the container.

2. The food storage unit as claimed in claim 1 comprising:

the cover comprising an indent;

the indent traversing into the top surface; and the indent being configured to receive a base of a stacked container.

3. The food storage unit as claimed in claim 1 comprising:

the second lip comprising a lateral-release ridge;

the lateral-release ridge being perimetrically connected to the second outer wall;

the lateral-release ridge being adjacently positioned to the latching member; and the second outer wall being positioned in between the second ridge and the lateral-release ridge.

4. The food storage unit as claimed in claim 1 comprising:

a plurality of cover-support tabs;

the plurality of cover-support tabs being connected in between the second lateral body, the second inner wall and the sealing insert; and the plurality of cover-support tabs being radially distributed around the second lateral body, the second inner wall and the sealing insert.

5. The food storage unit as claimed in claim 1 comprising:

the channel ridge and the first ridge being parallel with each other.

6. The food storage unit as claimed in claim 1 comprising:

the inside obtuse angle being 95 degrees.

7. The food storage unit as claimed in claim 1 comprising:

a plurality of container-support tabs;

the plurality of container-support tabs being connected in between the channel ridge, the first lateral body, the third lateral body and the floor; and the plurality of container-support tabs being radially distributed around the channel ridge, the first lateral body, the third lateral body and the floor.

8. The food storage unit as claimed in claim 1 comprising:

the first inner wall being angularly offset from the floor by another inside obtuse angle; and the another inside obtuse angle being formed within the channel.

9. The food storage unit as claimed in claim 8, wherein the another inside obtuse angle is 95 degrees.

10. The food storage unit as claimed in claim 1 comprising:

the first inner wall being angularly offset from the first ridge by an obtuse angle.

11. The food storage unit as claimed in claim 10, wherein the obtuse angle is 95 degrees.

12. The food storage unit as claimed in claim 1 comprising:

the first outer wall being angularly offset from the first ridge by an obtuse angle.

13. The food storage unit as claimed in claim 12, wherein the obtuse angle is 95 degrees.

14. The food storage unit as claimed in claim 1 comprising:

the sealing insert and the second ridge being parallel with each other.

15. The food storage unit as claimed in claim 1 comprising:

the second inner wall being angularly offset from the second ridge by an obtuse angle.

16. The food storage unit as claimed in claim 15, wherein the obtuse angle is 95 degrees.

17. The food storage unit as claimed in claim 1 comprising:

the floor being angularly offset from the first lateral body by an obtuse angle.

18. The food storage unit as claimed in claim 17 comprising:

the obtuse angle being 95 degrees.

19. The food storage unit as claimed in claim 1 comprising:

the second outer wall being angularly offset from the second ridge by an obtuse angle.

20. The food storage unit as claimed in claim 19 comprising:

the obtuse angle being 95 degrees.

* * * * *